US006412575B1

(12) United States Patent
Harrigan et al.

(10) Patent No.: US 6,412,575 B1
(45) Date of Patent: Jul. 2, 2002

(54) CORING BIT AND METHOD FOR OBTAINING A MATERIAL CORE SAMPLE

(75) Inventors: Edward Harrigan, Richmond; Robert W. Sundquist, The Woodlands; Bunker M. Hill, Sugar Land; Dean W. Lauppe, Pasadena; Gary W. Contreras; Sony Tran, both of Missouri City, all of TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/521,505

(22) Filed: Mar. 9, 2000

(51) Int. Cl.[7] ..... E21B 25/08

(52) U.S. Cl. ..... 175/20; 175/58; 175/332; 175/403

(58) Field of Search ..... 175/20, 58, 332, 175/403, 405

(56) References Cited

U.S. PATENT DOCUMENTS 4,790,396 A * 12/1988 Fuller ..... 175/249
5,987,698 A * 11/1999 Koenig et al. ..... 175/209

FOREIGN PATENT DOCUMENTS

| | | | |
|---|---|---|---|
| GB | 2 181 766 A | * | 4/1987 |
| WO | WO 97/26438 | | 7/1997 |
| WO | WO 97/26439 | | 7/1997 |
| WO | WO 97/26440 | | 7/1997 |
| WO | WO 97/26441 | | 7/1997 |

OTHER PUBLICATIONS

Commercial brochure, *Sidewall CoreDriller* Tool*, Schlumberger (Aug. 1990).
Commercial brochure, *Rotary Sidewall Coring Tool (RCOR)*, Western Atlas (1992).

* cited by examiner

*Primary Examiner*—William Neuder
(74) *Attorney, Agent, or Firm*—Steven L. Christian; JL Jennie Salazar

(57) ABSTRACT

The present invention provides a brush bit for cutting a core sample from an unconsolidated formation with reduced fragmentation or damage to the core sample by using a plurality of stiff bristles to cut rock from around the core sample. The present invention also provides an improved method of obtaining a core sample from an unconsolidated formation.

21 Claims, 4 Drawing Sheets

CORING BIT AND METHOD FOR OBTAINING A MATERIAL CORE SAMPLE

FIELD OF THE INVENTION

The present invention provides an improved coring bit and method for obtaining a material core sample from the bore wall of a drilled well.

BACKGROUND OF THE RELATED ART

Wells are generally drilled to recover natural deposits of hydrocarbons and other desirable, naturally occurring materials trapped in geological formations in the earth's crust. A slender well is drilled into the ground and directed to the targeted geological location from a drilling rig at the surface. In conventional "rotary drilling" operations, the drilling rig rotates a drillstring comprised of tubular joints of steel drill pipe connected together to turn a bottom hole assembly (BHA) and a drill bit that is connected to the lower end of the drillstring. During drilling operations, a drilling fluid, commonly referred to as drilling mud, is pumped and circulated down the interior of the drillpipe, through the BHA and the drill bit, and back to the surface in the annulus.

Petroleum and other naturally occurring deposits of minerals or gas often reside in porous geologic formations deep in the Earth's crust. These formations are targeted and slender wells are bored deep into the Earth's crust to access and recover the reserves within the formations. Once a formation of interest is reached in a drilled well, geologists or engineers often investigate the formation and the deposits therein by obtaining and analyzing a representative sample of rock. The representative sample is generally cored from the formation using a hollow, cylindrical coring bit, and the sample obtained using this method is generally referred to as a core sample. Once the core sample has been transported to the surface, the core sample is analyzed to evaluate the reservoir storage capacity (porosity), the flow potential (permeability) of the rock that makes up the formation, the composition of the fluids that reside in the formation, and to measure irreducible water content. These estimates are used to design and implement well completion; that is, to selectively produce certain economically attractive formations from among those accessible by the well. Once a well completion plan is in place, all formations except those specifically targeted for production are isolated from the target formations, and the deposits within targeted formations are selectively produced through the well to the surface.

Several tools and methods of obtaining core samples have been used in coring. There are generally two types of coring methods and apparatus, namely rotary coring and percussion coring. Rotary coring is generally performed by forcing an open and exposed circumferential end of a hollow cylindrical coring bit against the end wall or the side wall of the bore hole and rotating the coring bit. Coring at the end wall of the bore hole and in the direction of drilling of the bore hole is generally referred to as "conventional" coring. In both conventional or side wall coring, the coring tool is generally secured against the wall of the bore hole with the rotary core bit oriented towards the wall of the bore adjacent to the formation of interest. The coring bit is generally deployed in either an axial (conventional) or a radial (side wall) direction away from the coring tool and against the bore wall by an extendable shaft or other mechanical linkage. The coring tool generally simultaneously imparts rotational torque and axial force (weight on bit) to the core bit to affect cutting of a core sample. The circumferential cutting edge of the bit is usually embedded with carbide, diamonds or other hard materials with superior hardness for cutting into the rock comprising the target formation. As the core sample is cut, the cylindrical core sample is received within the hollow barrel of the coring bit as cutting progresses and the bit penetrates the formations. After the desired length of the core sample or the maximum extension of the core bit is reached, the core sample may be broken from the remaining interface or connection with the formation by slightly tilting the bit and the protruding core sample within the bit from their cored orientation.

In side wall rotary coring, the core sample is broken free from the formation and the core sample is retrieved into the coring tool through retraction of the same shaft or mechanical linkage that was used to deploy the coring bit to and against the side wall. Once the coring bit has been retracted within the coring tool, the retrieved core sample is generally ejected from the coring bit to allow use of the coring bit for obtaining subsequent samples at the same or other formations of interest. This multiple coring feature is generally unavailable with conventional coring.

The second common type of coring is percussion coring. Percussion coring uses multiple cup-shaped percussion coring bits that are propelled against the wall of the bore hole with sufficient force to cause the bits to forcefully enter the rock wall such that core samples are obtained within the open end of the percussion coring bits. These bits are generally pulled from the bore wall using flexible connections between the bit and the coring tool such as cables, wires or cords. The coring tool and the attached bits are returned to the surface, and the core samples are recovered from the percussion coring bits for analysis.

The selection of either rotary or percussion coring is generally based on several factors. For certain types of rock, percussion coring provides limited useful information because the violent impact of the bit physically fractures and damages a localized portion of the bore wall including the portion recovered as the core sample. For these types of formations, rotary coring is the preferred method of obtaining a core sample that retains its natural properties and will provide reliable geologic data. However, rotary coring with prior art coring bits may also damage certain types of core samples and thereby compromise the value of the data obtained from analysis of the core sample. Many types of unconsolidated formations comprise a relatively soft matrix containing harder rock particles dispersed within the matrix. Core samples from these unconsolidated formations may be damaged, fractured or shattered when cut or removed by rotary coring bits, not to mention percussion bits, because prior art coring bits are generally rigid with carbide or diamond "teeth" that are incompatible with the physical properties of unconsolidated formations.

The retrieval and analysis of core samples in their undamaged condition provides valuable geologic information that drastically improves analysis and decision making on the part of the driller. What is needed is an improved coring bit and method of obtaining core samples that better cuts and preserves core samples from unconsolidated, soft or matrix formations, and that provides core samples at or near their original, undamaged condition within the formation. It is preferred that the improved coring bit and method be useful with existing coring tools.

SUMMARY OF THE INVENTION

The present invention provides a brush bit for improved cutting of core samples from unconsolidated formations, and a method of cutting a core sample using a brush instead of rigid cutting teeth. The brush bit uses a plurality of protruding stiff, flexible bristles to more delicately "cut" an unconsolidated rock matrix to create a protruding core sample that can be retrieved to within the coring tool. The resulting core sample is either undamaged or less damaged than by forceful displacement of dispersed rock particles within the softer formation matrix. The bristles of the brush bit may be of various lengths, gauges, spacings and firmness, and may be arranged in any pattern that facilitates cutting of the core sample. The bristles of the brush bit may be braided or twisted together, bundled or may extend separately from the base of the brush bit. The brush bit may be rotated like conventional rotary coring bits, or it may be oscillated or vibrated in a manner that causes the desired removal of formation material from around the core sample. The base of the brush bit may have internal or external grooves or channels to assist in removal of cuttings and debris or to impart a secondary reaming or boring effect to the brush bit.

DESCRIPTION OF DRAWINGS

So that the features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Coring is a process of removing an inner portion of a material by cutting with an instrument. While some softer materials may be cored by forcing a coring sleeve translationally into the material, for example soil or an apple, harder materials generally require cutting with rotary coring bits; that is, hollow cylindrical bits with cutting teeth disposed about the circumferential cutting end of the bit. Coring is used in many industries to either remove unwanted portions of a material or to obtain a representative sample of the material for analysis to obtain information about its physical properties. Coring is extensively used to determine the physical properties of downhole geologic formations encountered in mineral or petroleum exploration and development.

The meaning of "cutting", as that term is used herein, includes, but is not limited to, brushing, rubbing, scratching, digging, abrading, defining, fashioning and otherwise removing support from around the core sample. Further, the meaning of a "brush", as that term is used herein, includes, but is not limited to, devices that include bristles. "Bristles", as that term is used herein, includes, but is not limited to, a plurality of stiff, slender appendages. "Stiff", as used herein, means firm in resistance or difficult to bend. "Slender" means little width relative to length. The meaning of "appendage", as that term is used herein, includes, but is not limited to, a part that is joined or attached to a principal object. The term "channel" as used herein refers to a channel, passage, bore, groove, trench, furrow, duct or flute.

Figures 1, 2:
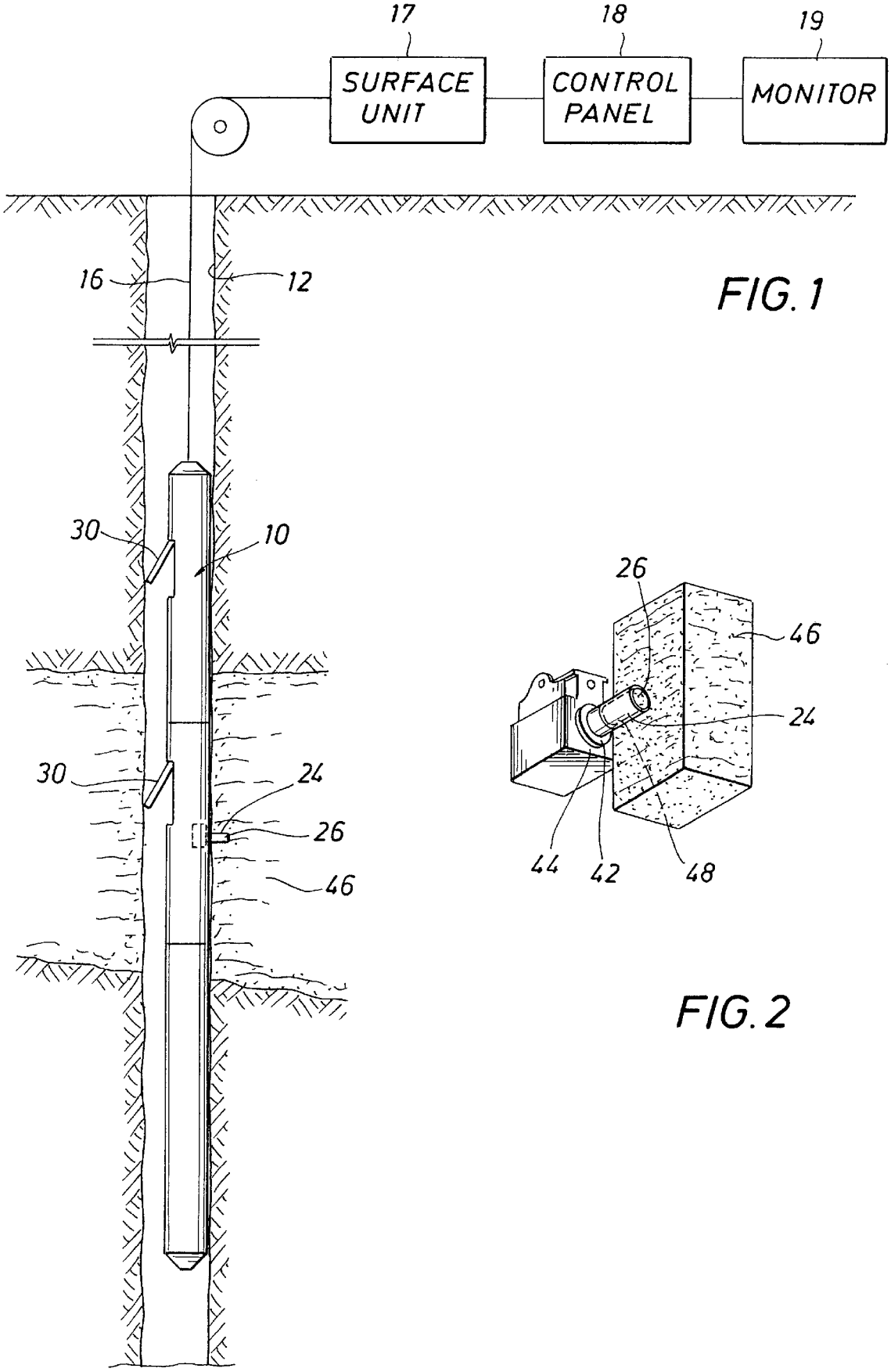
FIG. 1 shows the general features of a coring tool in use in a drilled well.
FIG. 2 shows a prior art coring bit extended from a coring tool and cutting a core sample from a target geologic formation.

FIG. 1 shows the general features of a coring tool in use in a drilled well for coring a downhole geologic formation. The coring tool 10 is lowered into the bore hole defined by the bore wall 12, often referred to as the side wall. The coring tool 10 is connected by one or more electrically conducting cables 16 to a surface unit 17 that typically includes a control panel 18 and a monitor 19. The surface unit is designed to provide electrical power to the coring tool 10, to monitor the status of downhole coring and activities of other downhole equipment, and to control the activities of the coring tool 10 and other downhole equipment. The coring tool 10 is generally contained within an elongate housing suitable for being lowered into and retrieved from the slim bore hole. The coring tool 10 contains a coring assembly generally comprising a motor 44, a coring bit 24 having a distal, open end 26 for cutting and receiving the core sample, and a mechanical linkage for deploying and retracting the coring bit from and to the coring tool 10 and for rotating the coring bit against the side wall. FIG. 1 shows the core tool 10 in its active, cutting configuration. The coring tool 10 is positioned adjacent to the target geologic formation 46 and secured firmly against the side wall 12 using anchoring shoes 28 and 30 extended from the opposing side of the coring tool from the coring bit. The distal, open end 26 of the coring bit 24 is rotated against the target geologic formation to cut the core sample.

FIG. 2 shows a perspective view of the coring bit 24 after it has cut into the target geologic formation 46. The coring bit 24 is fixedly connected to a base 42 which is, in turn, connected to and turned by a coring motor 44. The core sample 48 is received into the hollow interior of the coring bit 24 as cutting progresses.

Conventional coring bits used in rotary cutting of core samples from downhole geologic formations are generally constructed of very rigid materials, steel for example, and often have particles of very hard materials embedded in the circumferential cutting edge of the bit. These hard materials are designed to cut a circumferential groove around a core sample. The core sample is generally approximately 1 inch in diameter and the coring bit usually cuts approximately 1 to 2 inches into the formation side wall, thereby creating a protruding cylindrical core sample that can be broken from the formation and retrieved to the surface for analysis. It should be noted that the actual size of a core sample may vary widely and is not a limitation of the present invention.

Many formations are made of hard, consolidated rock, and these conventional rotary coring bits perform well in cutting core samples from these types of formations; that is, the core samples that are cut and retrieved provide the driller with valuable information such as porosity, permeability and content of the targeted formation. However, some mineral-bearing geologic formations are made of softer, unconsolidated rock comprising small hard rock particles held in a fixed relationship within a softer rock matrix. Unconsolidated core samples are often so fragile that they may crumble upon handling by human hands. Core samples recovered from unconsolidated formations using conventional rigid coring bits are often fractured and damaged as a result of the cutting action of the coring bit and the forces imparted to the geologic formation by the coring process. Fractured or damaged core samples obtained from unconsolidated formations typically provide very poor representations of the geologic properties of the formations from which they are obtained. The lack of information regarding the formation rock results in less effective decision making during the completion phase of a well due to the lack of reliable geologic data.

Figure 3:
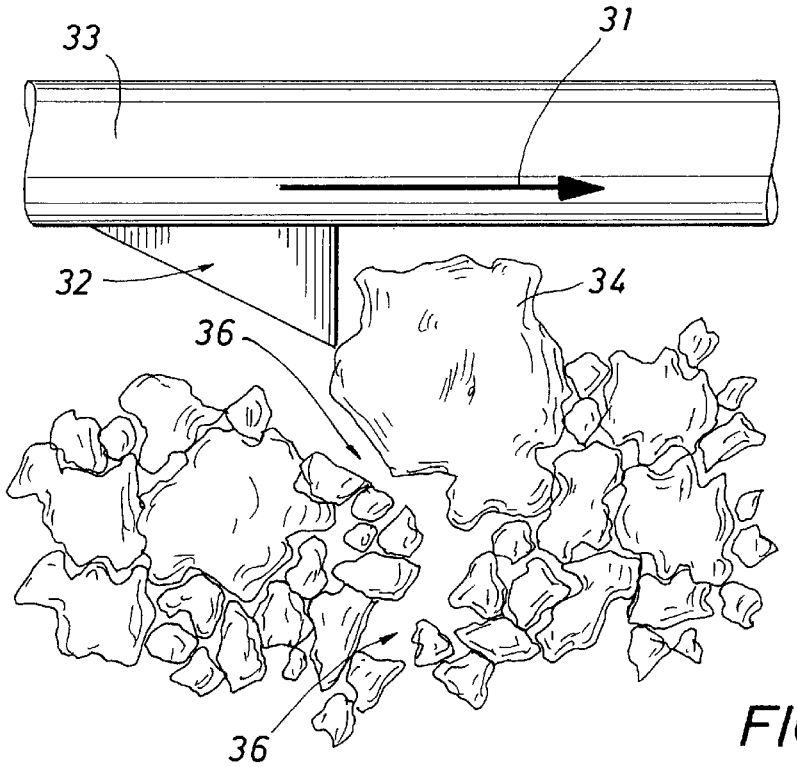
FIG. 3 (PRIOR ART)
FIG. 3 shows the crushing force imparted by a rigid tooth of a prior art coring bit and the resulting damage to the core sample of an unconsolidated formation.

To best understand the advantages provided by the present invention, it is important to understand the mechanics of the coring process. FIG. 3 is a depiction of the mechanics of the interaction between a hard cutting tooth 32 of a conventional coring bit and the components 34 and 36 of an unconsolidated formation, and the fracturing of the core sample that results from this interaction. The hard carbide or diamond coring bit tooth 32 is embedded in the circumferential cutting edge 33 of the coring bit. The tooth 32 engages the formation as determined by the tangential direction 31 of the localized portion of the cutting edge 33 of the coring bit. The moving tooth 32 forcefully engages a small, hard rock particle 34 that is held within the softer formation matrix 36. Instead of breaking or crushing upon impact by the tooth 32, the small, hard rock particle 34 is displaced by the force of the tooth 32, and the force exerted by the tooth 32 is transferred through the hard rock particle 34 to the surrounding softer formation matrix 36. The force transferred from the tooth 32 to the matrix 36 through the small, hard rock particle causes the matrix to severely fragment, separate, mobilize, disengage, or crush. The fragmentation and crushing of the formation matrix physically damages the core sample, thereby irreversibly compromising the geologic data available to the driller through analysis of the retrieved core sample. The present invention overcomes the problems arising from the use of conventional coring bits for cutting core samples from unconsolidated formations.

Figure 4:
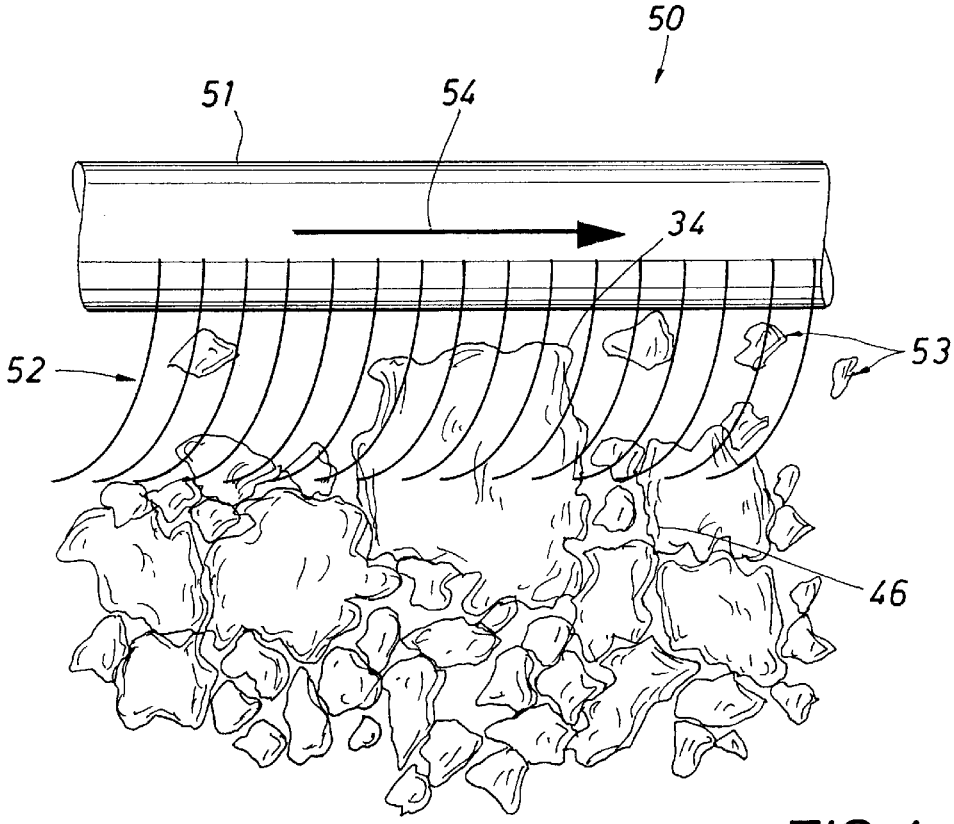
FIG. 4 shows the non-destructive brushing action of stiff bristles used to cut a core sample from an unconsolidated formation.

FIG. 4 depicts the mechanics of how the bristles of the brush bit interact with an unconsolidated formation to reduce or eliminate damage to the core sample. The brush bit 50 better preserves core samples by using bristles 52 moving in direction 54 to contact, mobilize and remove small particles 53 from the soft rock matrix that surrounds harder rock particles 34 held therein. This leaves the harder rock particles 34 free for removal from the cutting zone without the fragmentation and damage to the adjacent core sample that occurs with conventional, rigid coring bits.

Figure 5:
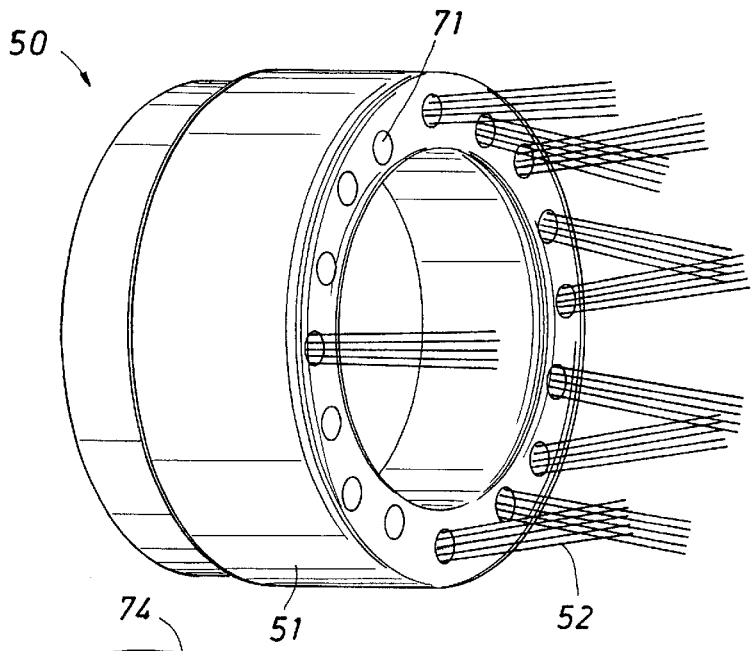
FIG. 5 is a perspective view of a brush bit having stiff bristles.

FIG. 5 shows an embodiment of the brush bit 50 having stiff bristles 52 disposed within receptacles 71 within the base 51 arranged in a circular pattern. The brush bit 50 has an interior space, cavity, channel, bore or passage for receiving the core sample cut by the bristles 52. FIG. 5 shows many of the bristles 52 of brush 50 removed from a subset of the receptacles 71 for illustration purposes only. The bristles 52 of the brush bit 50 may have a diameter ranging from 0.01 to 0.2 inches, but preferably in the range from 0.05 to 0.12 inches. The bristles 52 may comprise individual strands of wire or other stiff materials, but preferably comprise flexible cables comprising a number of bristles or strands braided together such as a 0.125" diameter 1×19 strand core 316 stainless steel wire rope, part number 8908T12 available from McMaster Carr. The bristles 52 of the brush bit 50 may have a length ranging from 0.1 to 2.5 inches, but the bristle length is preferably in the range of 0.4 to 1.25 inches. The optimal length of the bristles 52 may depend on the stiffness of the material from which the bristles 52 are formed and the diameter of the brush bit 50. The bristles 52 may be of a variety of stiff materials that are chemically compatible with the fluids residing in the formations from which the core samples are cut and with the fluids used in drilling or completion of the well. The rotational speed of the brush bit may be from zero revolutions per minute for brush bits that are designed to operate using vibrations or oscillation to 5,000 revolutions per minute, but preferably in the range from 500 to 750 revolutions per minute.

Figure 6:
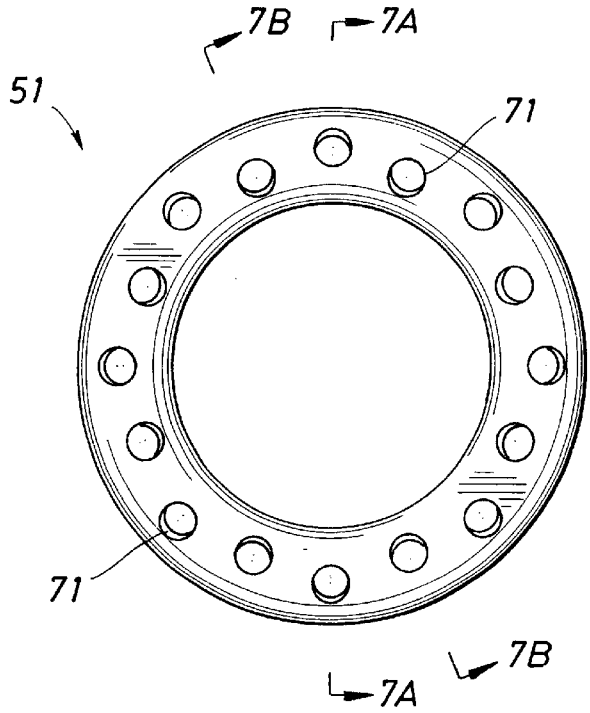
FIG. 6 is a cross sectional view of a brush bit having receptacles arranged in a circular pattern for holding bristles.

The circular pattern is suitable for rotary brush bits such as that shown in FIG. 6 that are similar in operation to the conventional rigid bits in the prior art. Although the brush bit 50 may be rotated against the formation 46 like conventional rotary coring bits to cut the core sample, it may also be oscillated or vibrated against the formation to affect the desired mechanical cutting of the core sample. The brush bit 50 does not necessarily have to be cylindrical or circular in form. Even a brush bit designed for rotation about a central axis may have a non-circular cross section. The bristles 52 of the brush bit 50 may comprise wire, synthetic fibers, carbon or other materials capable of being fashioned into a stiff bristle. Furthermore, the brush bit may comprise any number of rows of bristles in various spacings, orientations and configurations.

Figure 8:
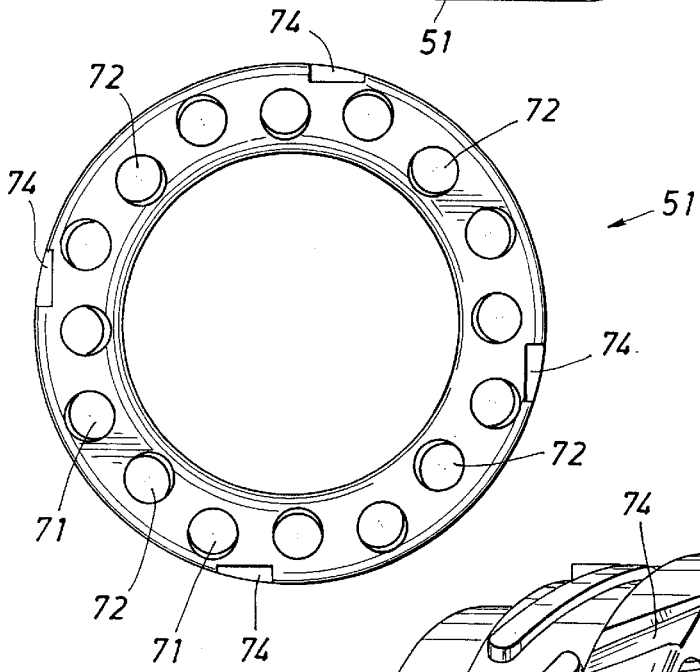
FIG. 8 is an end view of the base of a brush bit having debris removal channels bored within its wall and debris removal grooves machined into its exterior wall.
Figure 7A:
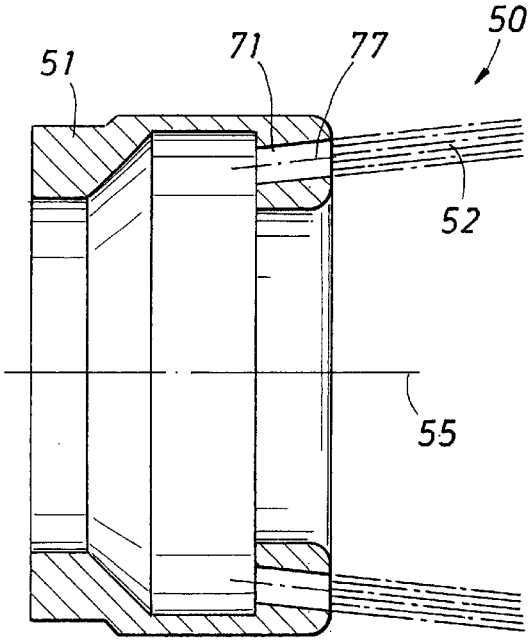
FIGS. 7A and 7B show cross sectional views of a base of a brush bit having outwardly angled and inwardly angled bristles and holding channels, respectively.
Figure 7B:
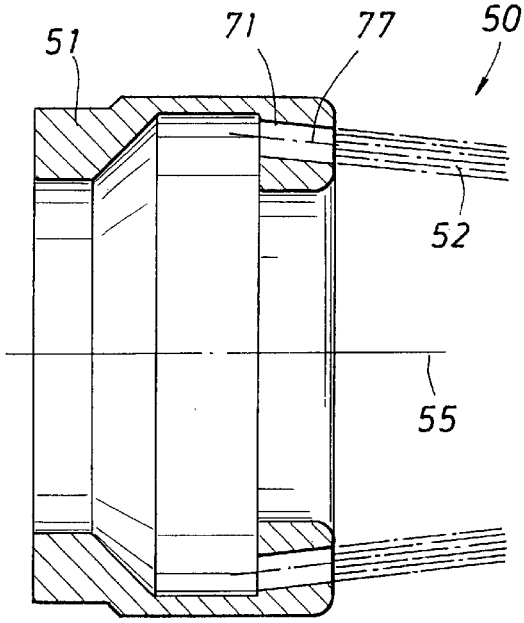

FIGS. 7A and 7B are cross sectional drawings showing bristles 52 secured within receptacles 71 in the base 51 of the brush bit 50 at an angle to the axis 55 of the brush bit 50. FIG. 7A is a cross sectional drawing taken through receptacles 71 that are disposed a few degrees radially outwardly from the axis 55, and FIG. 7B is a cross sectional drawing taken through receptacles 71 that are disposed a few degrees radially inwardly from the axis 55. The outwardly and inwardly disposed bristles 52 and receptacles 71 are preferably distributed in a circular alternating pattern about the axis 55 of the brush bit 50 as shown in FIGS. 5, 6 and 8. The angle 77 formed by the base channel 71 to the axis 55 is in the range from zero (for axially aligned bristles) to 45 degrees, but preferably in the range from zero to 10 degrees, most preferably about 5 degrees. The angular orientation of the bristles 52 imparted by the angled receptacles 71, in combination with the length of the bristles, provides increased width to the cutting zone from which material is removed during the cutting of the core sample. This increased cutting zone width prevents interference between the base 51 and either the core sample or the formation when the core sample is being cut and received within the hollow interior of the coring bit 50.

Figure 9:
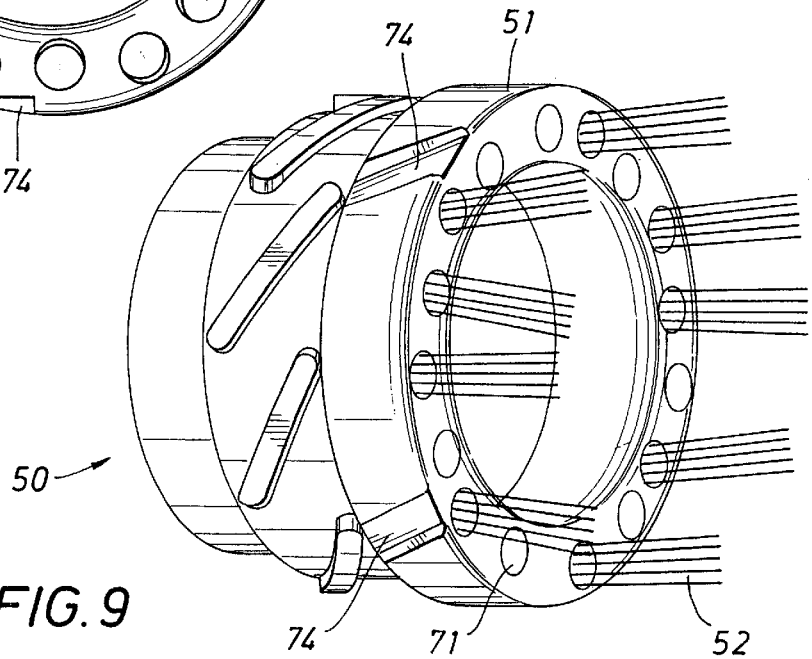
FIG. 9 is a perspective view of a brush bit having debris removal channels bored within its wall and debris removal grooves machined into its exterior wall.

FIG. 8 is an end view, and FIG. 9 is a prospective view, of a brush bit 50 having debris removal channels 72 bored within the cylindrical wall of the base 51 and debris removal grooves 74 machined into the external wall of the cylindrical base 51. The base 51 may comprise one or more debris removal channels 72 bored through and within the wall of the base 51. The debris removal channels 72 begin at entrance openings adjacent to the receptacles 71 and terminate at exit openings (not shown) on or near the face of the base 51 disposed toward the coring tool 10. The debris removal grooves 74 may be machined into the external cylindrical wall of the base 51 or into the interior wall defining the hollow interior around axis 55 of the base 51. The debris removal grooves 74 begin at the circumferential edge of the end of the base 51 of the brush bit 50 adjacent to the bristle channels 71 and terminate at a point on the circumferential exterior of the base 51 of the brush bit 50. The debris removal channels 72 or the debris removal grooves 74 may be bored in a helix or spiral path about the axis of the brush bit 50. The helix or spiral path may be designed to utilize the rotation, vibration or oscillation of the brush bit 50 to motivate debris entering the entrance openings 72 towards away from the cutting zone. The debris removal grooves 74 primarily remove debris from the cutting zone, but may also provide a secondary benefit of reaming or boring on either the interface between the cutting zone and the formation or the interface between the cutting zone and the core sample, or both.

While the foregoing is directed to the preferred embodiment of the present invention, other and further embodiments of the invention may be devised without departing from the basic scope thereof, and the scope thereof is determined by the claims which follow.

We claim:

1. A coring bit comprising:

a base having a proximal end, a distal end and a central axis therethrough, the base defining an interior space about the central axis for receiving a core sample, the proximal end connectable to a motor whereby the base is driven; and a plurality of bristles extending from the distal end of the base, the bristles capable of brushing material surrounding the core sample whereby the core sample is cut.

2. The coring bit of claim 1, wherein the bristles are wire.

3. The apparatus of claim 2 wherein the bristles comprise wires braided to form a cable.

4. The coring bit of claim 1, wherein the bristles are fibers.

5. The coring bit of claim 1, wherein a portion of the bristles are connected one to another at their distal ends.

6. The coring bit of claim 1, wherein the base comprises at least one debris removal channel bored within a wall in the cylindrical base of the coring bit and parallel to the axis of the coring bit.

7. The coring bit of claim 1, wherein the base comprises a wall with at least one debris removal channel bored within the wall of the base and in a spiral path about the central axis.

8. The apparatus of claim 7 wherein the spiral path forms a helix.

9. The coring bit of claim 1, wherein the interior space is defined by a wall having at least one debris removal groove cut in a spiral path about the central axis.

10. The apparatus of claim 9 wherein the spiral path forms a helix.

11. The apparatus of claim 1 wherein the bristles are substantially co-terminating.

12. The apparatus of claim 1 wherein a portion of the bristles are disposed at an angle to the axis of the base of the coring bit.

13. The apparatus of claim 12 wherein the angle is between zero and 45 degrees.

14. The apparatus of claim 12 wherein the angle is between zero and 10 degrees.

15. A method of obtaining a core sample from a material comprising the step of brushing to remove a surrounding portion of the material whereby a core sample is cut.

16. An apparatus for cutting a core sample from a material comprising:

a plurality of bristles having proximal ends and distal ends;

a base securing the proximal ends of the bristles; and a means of imparting motion to the base so that the bristles brush the material surrounding the core sample whereby the core sample is cut therefrom.

17. The apparatus of claim 16 wherein the motion is rotation.

18. The apparatus of claim 17 wherein the base has an angular velocity of rotation in the range of from about 500 to about 750 revolutions per minute.

19. The apparatus of claim 17 wherein the base has an angular velocity of rotation between about 100 and about 2000 revolutions per minute.

20. The apparatus of claim 16 wherein the motion is selected from vibration and oscillation.

21. A method of obtaining a core sample from a subsurface formation, comprising the steps of:

applying torque to a tubular member having bristles extending from a leading circular edge thereof to rotate the bristles about the axis of the tubular member;

moving the tubular member towards and through the wall of a wellbore that penetrates a subsurface formation so that the bristles cut through the wellbore wall and cut a substantially tubular annulus into the formation behind the wellbore wall; and removing the resulting sample of the formation that lies within the tubular member following the tubular annulus cut.

* * * * *